US011519218B2

(12) United States Patent
Luvison

(10) Patent No.: US 11,519,218 B2
(45) Date of Patent: Dec. 6, 2022

(54) WINDOW ASSEMBLY

(71) Applicant: Associated Materials, LLC, Cuyahoga Falls, OH (US)

(72) Inventor: Michael Luvison, Cuyahoga Falls, OH (US)

(73) Assignee: Associated Materials, LLC, Cuyahoga Falls, OH (US)

( * ) Notice: Subject to any disclaimer, the term of this patent is extended or adjusted under 35 U.S.C. 154(b) by 41 days.

(21) Appl. No.: 17/101,993

(22) Filed: Nov. 23, 2020

(65) Prior Publication Data

US 2021/0246716 A1 Aug. 12, 2021

Related U.S. Application Data

(60) Provisional application No. 62/970,941, filed on Feb. 6, 2020.

(51) Int. Cl.

| | |
|---|---|
| ***E06B 3/22*** | (2006.01) |
| ***E06B 3/68*** | (2006.01) |
| ***E06B 3/96*** | (2006.01) |
| ***E06B 3/964*** | (2006.01) |
| ***E06B 3/968*** | (2006.01) |

(52) U.S. Cl.

CPC ..... *E06B 3/9647* (2013.01); *E06B 3/22* (2013.01); *E06B 3/685* (2013.01); *E06B 3/968* (2013.01)

(58) Field of Classification Search

CPC ... E06B 3/22; E06B 3/68; E06B 3/685; E06B 3/968; E06B 3/9647; E06B 3/9642; E06B 1/26; E06B 1/366

USPC ..... 52/209

See application file for complete search history.

(56) References Cited

U.S. PATENT DOCUMENTS

| | | | | | |
|---|---|---|---|---|---|
| 1,101,745 | A | * | 6/1914 | Jones | E06B 3/685 52/456 |
| 2,354,054 | A | * | 7/1944 | Plym | E06B 3/96 52/456 |
| 2,565,937 | A | * | 8/1951 | Verhagen | E06B 3/66328 52/204.597 |
| 5,906,083 | A | * | 5/1999 | Olsen | E06B 7/08 52/302.1 |
| 6,085,481 | A | * | 7/2000 | Lee | E06B 9/01 49/501 |

(Continued)

FOREIGN PATENT DOCUMENTS

| | | | | | |
|---|---|---|---|---|---|
| FR | 2213402 | A | * | 9/1974 | E06B 3/685 |

*Primary Examiner* — Ryan D Kwiecinski

(74) *Attorney, Agent, or Firm* — Knobbe, Martens, Olson & Bear LLP

(57) ABSTRACT

A window assembly includes a polymer (e.g., polyvinyl chloride, vinyl) window frame made and a glass unit carried by the window frame. The window frame includes a pair of jambs and an astragal that extends between and interconnects the pair of jambs. The jambs have a channel or slot sized to receive therethrough one or more end walls of the astragal so that at least a portion of said one or more end walls extend into a hollow cavity in the jambs that is in fluid communication with one or more weep holes of the window assembly. The one or more end walls of the astragal and channel or slot of the jambs define a flow path configured to channel water from the astragal, through the channel or slot in the jambs and into the hollow cavity such that said water exits the hollow cavity and the window assembly via the one or more weep holes.

8 Claims, 10 Drawing Sheets

(56) References Cited

U.S. PATENT DOCUMENTS

| | | | | |
|---|---|---|---|---|
| 6,244,013 | B1 * | 6/2001 | Lee | E06B 9/01 52/660 |
| 7,373,763 | B2 * | 5/2008 | Voegele, Jr. | E04C 1/42 52/656.5 |
| 7,426,805 | B2 * | 9/2008 | Voegele, Jr. | E04C 1/42 52/656.1 |
| RE43,251 | E * | 3/2012 | Anderson | E06B 3/96 49/504 |
| 8,998,527 | B2 * | 4/2015 | Clark | F16B 7/0473 403/231 |
| 9,624,713 | B2 * | 4/2017 | Campbell | E06B 1/366 |
| 11,131,140 | B2 * | 9/2021 | McKenna | F16B 5/0036 |
| 11,326,391 | B2 * | 5/2022 | Luvison | E06B 3/5821 |
| 2021/0246716 | A1 * | 8/2021 | Luvison | E06B 3/9647 |

* cited by examiner

WINDOW ASSEMBLY

INCORPORATION BY REFERENCE TO ANY PRIORITY APPLICATIONS

Any and all applications for which a foreign or domestic priority claim is identified in the Application Data Sheet as filed with the present application are hereby incorporated by reference under 37 CFR 1.57 and should be considered a part of this specification.

BACKGROUND

Field

Aspects of the present disclosure are directed to a window assembly, and more particularly to a window assembly with an improved astragal to jamb assembly.

Description of the Related Art

Windows assemblies include a frame and a glass unit (e.g., insulated glass unit or IGU). The window frame can be made from wood, metal, polymers (e.g., vinyl), or a variety of combinations of these materials. In vinyl windows, the astragal member 30 (see FIG. 1) is connected to the jamb 10 of the window assembly 100 with a butt joint. The butt joint includes a vertical joint 42*a* between a vertical wall 40 of the astragal 30 and a vertical wall 20 of the window assembly 100. The butt joint also includes a horizontal joint 32*c* between the astragal 30 and the vertical wall 20. The butt joint also includes a horizontal joint 32*a* and a vertical joint 32*b* between the astragal 30 and the jamb 10. The joints of the butt joint (e.g., vertical joint 42*a*, horizontal joints 32*a*, 32*c*, vertical joint 32*b*) can be caulked, but sometimes the joints are not caulked well or the caulking is damaged (e.g. during handling of the window assembly 100, where the caulking seal is damaged or broken), allowing water infiltration of the window assembly 100, such as via the vertical joint 42*a*. Additionally, water infiltration can occur via gap 33 between the astragal 30 and the jamb 10. Additionally, water infiltration can occur via screw bosses for the screws that connect the astragal to the jamb.

SUMMARY

Accordingly, there is a need for an improved polymer (e.g., vinyl) window assembly with an improved astragal to jamb assembly that inhibits (e.g., prevents) water infiltration via the astragal to jamb joint, as discussed above.

In accordance with one aspect of the invention, a polymer window assembly is provided. The window assembly includes a window frame made of a polymer material (e.g., polyvinyl chloride or vinyl) and a glass unit (e.g., a single pane of glass, two or more panes of glass in an insulated glass unit) carried by the window frame. The window frame includes a pair of jambs (e.g., vertical members) and an astragal (e.g., horizontal member) that extends between and interconnects the pair of jambs. The jambs have a channel or slot sized to receive therethrough one or more end walls of the astragal so that at least a portion of said one or more end walls of the astragal extend into a hollow cavity in the jambs that is in fluid communication with one or more weep holes of the window assembly. The one or more end walls of the astragal and channel or slot of the jambs define a flow path configured to channel water from the astragal, through the channel or slot in the jambs and into the hollow cavity such that said water exits the hollow cavity and the window assembly via the one or more weep holes.

In accordance with one aspect of the disclosure, a window assembly comprising a polymer window frame is provided. The polymer window frame comprises a pair of jambs, each having one or more slots formed in a surface thereof, and an astragal configured to extend between and interconnecting the pair of jambs, the astragal having one or more end portions configured to extend through the one or more slots in the jambs and into a hollow cavity of the jambs. The end portions of the astragal are configured to channel water into the hollow cavity of the jambs via the one or more slots in the jambs for draining of said water.

In accordance with another aspect of the disclosure, a window assembly comprising a polymer window frame is provided. The polymer window frame comprises a jamb having one or more slots formed in a surface thereof, and an astragal configured to attach to the jamb, the astragal having an end portion configured to extend through the one or more slots in the jamb and into a hollow cavity of the jamb. The end portion of the astragal is configured to channel water into the hollow cavity of the jamb via the one or more slots in the jamb for draining of said water.

DETAILED DESCRIPTION

Figure 1:
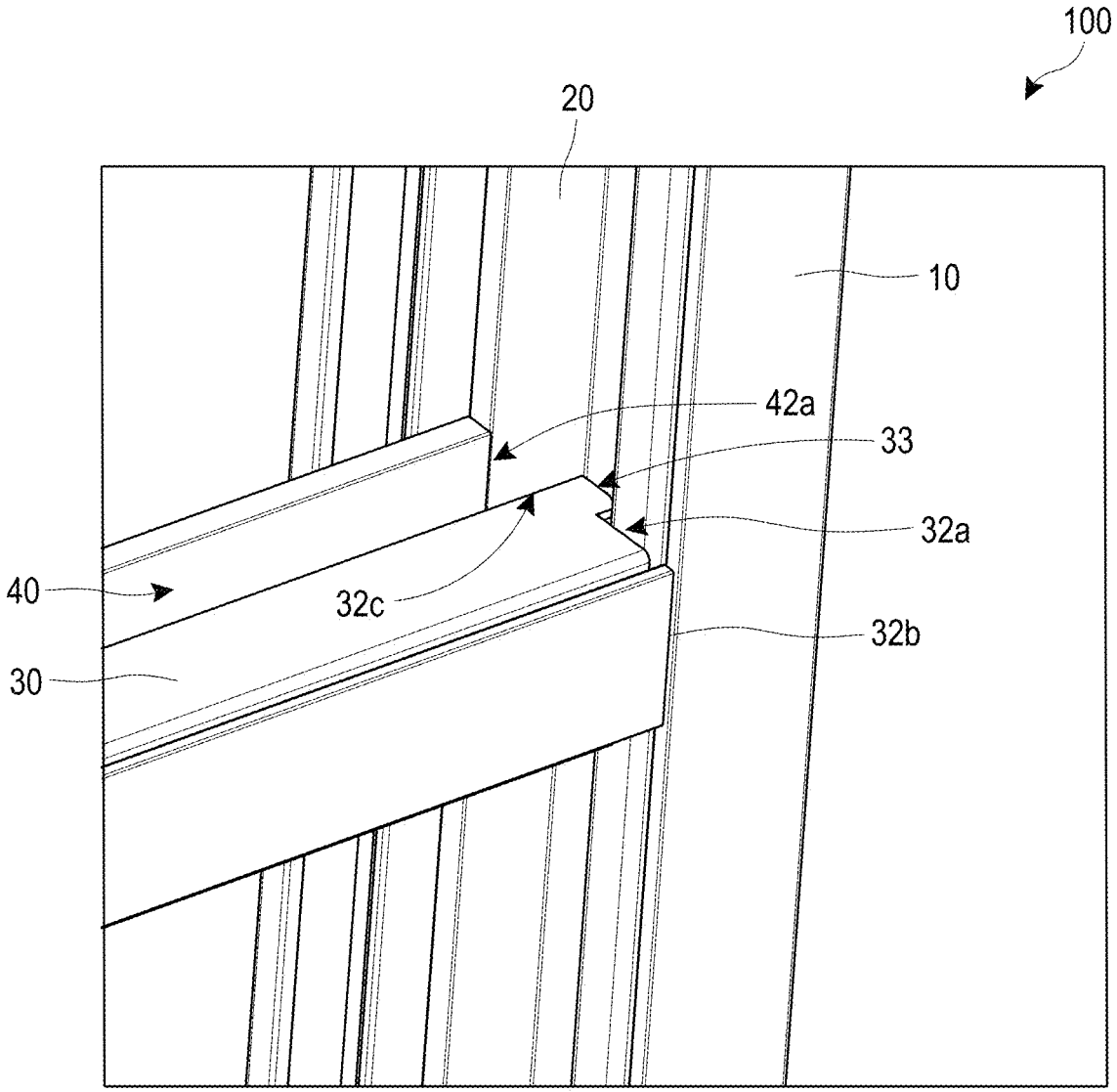
FIG. 1 (PRIOR ART)
FIG. 1 is a partial view of an astragal to jamb connection in an existing window assembly with a vinyl frame.
Figure 2:
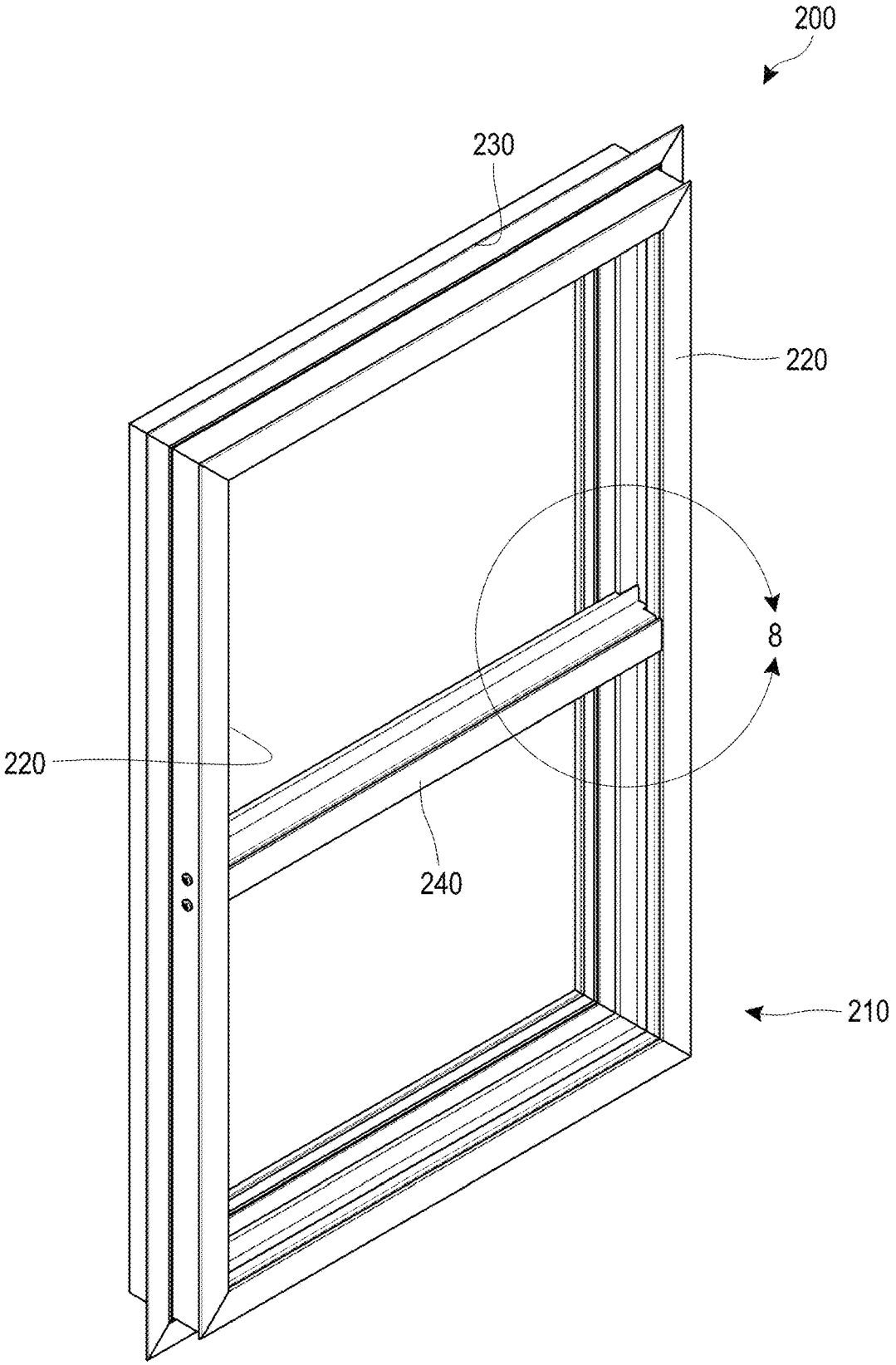
FIG. 2 is perspective view of a window assembly with an astragal to jamb connection.
Figure 3:
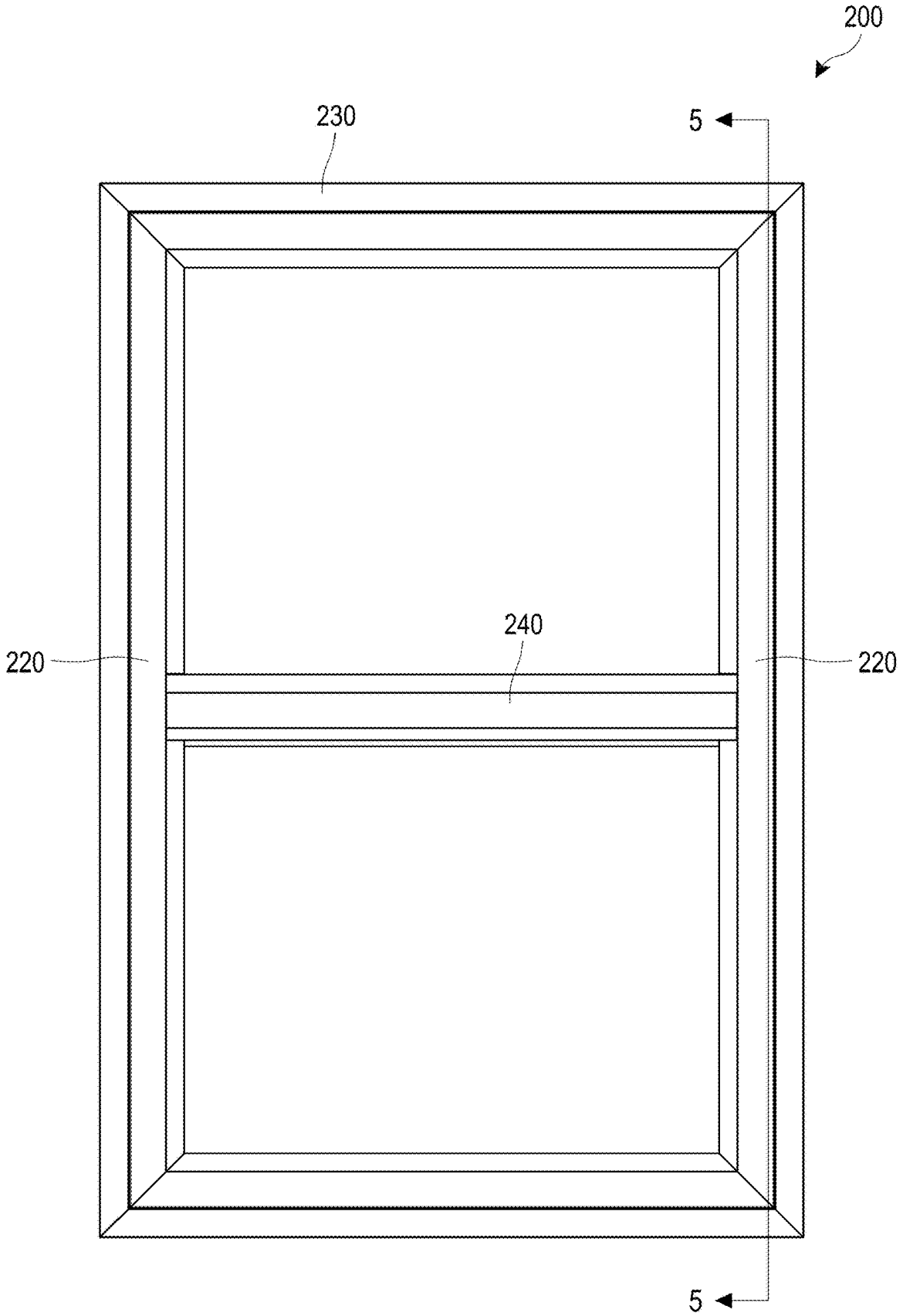
FIG. 3 is front view of the window assembly of FIG. 2.
Figure 4:
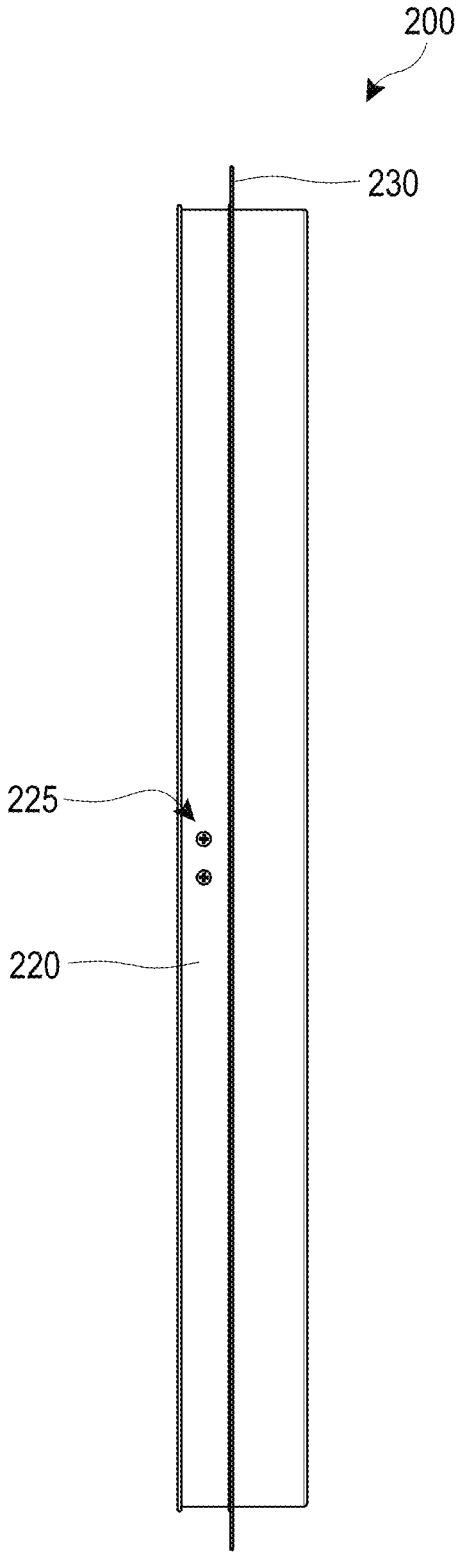
FIG. 4 is side view of the window assembly of FIG. 2.
Figure 5:
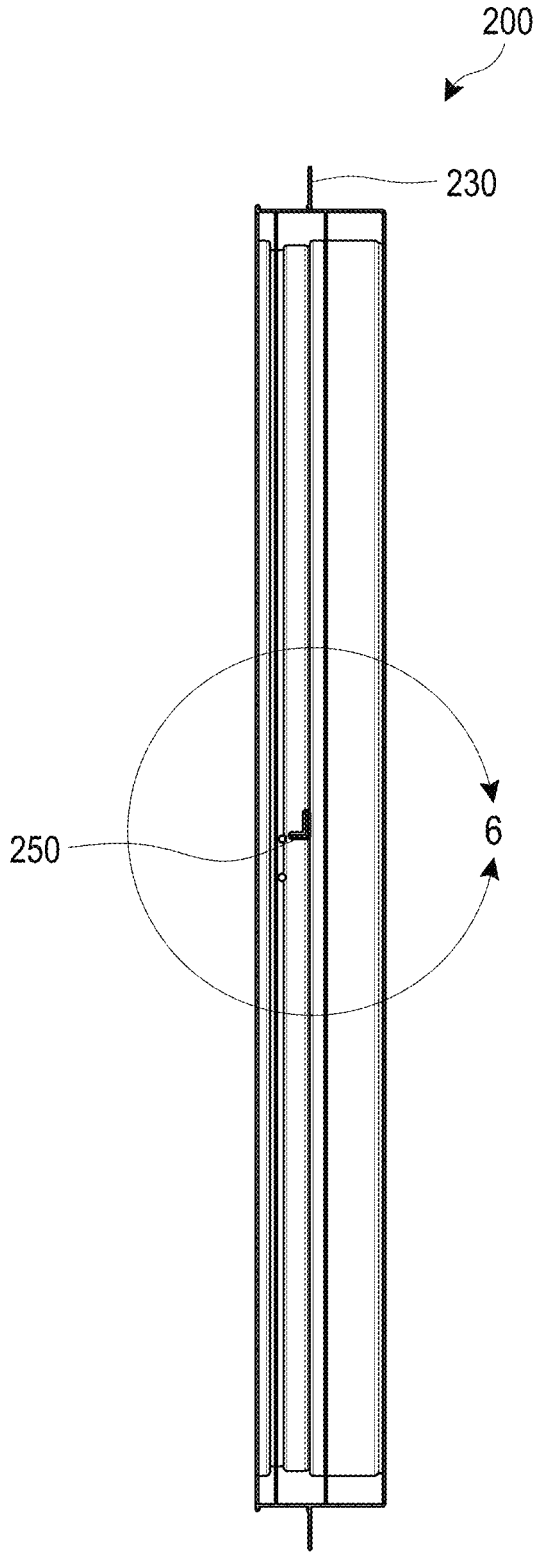
FIG. 5 is cross-sectional view of the window assembly of FIG. 3 along line 5-5.
Figure 6:
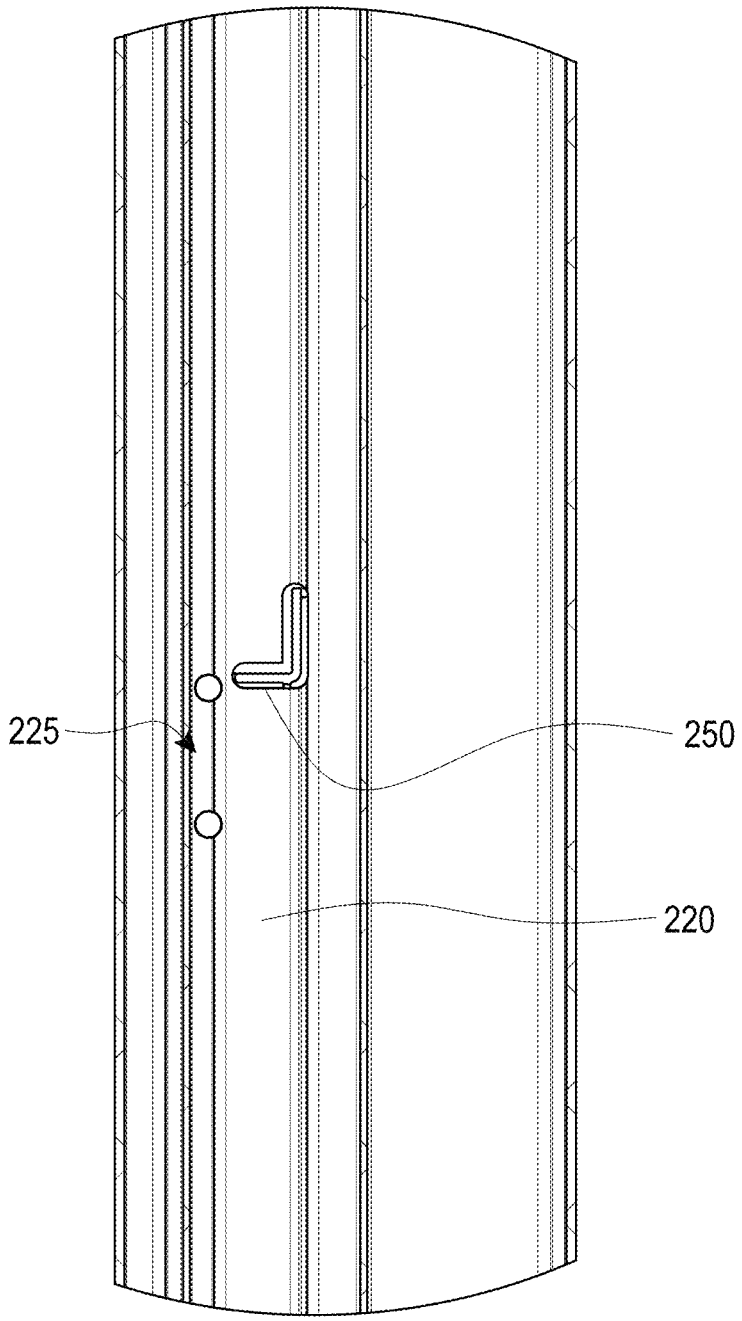
FIG. 6 is an enlarged sectional view of a portion of the window assembly of FIG. 5.

FIGS. 2-10 show a window assembly 200 with a window frame 210 having a pair of jambs 220 (e.g., upright or vertical members). The pair of jambs 220 extend substantially parallel to each other. The window frame 210 also includes an astragal 240 that extends between and interconnects the pair of jambs 220. The astragal 240 can extend generally orthogonal (e.g., perpendicular). The window assembly 200 can have a nail fin 230 that extends at least partially around the window frame 210.

The frame 210 of the window assembly 200 can be made of a polymer material (e.g., polyvinyl chloride or vinyl). The frame 210 can carry a glass unit. The glass unit can include one or more panes (e.g., two panes, three panes) of glass (e.g., in an insulated glass unit).

Figure 7A:
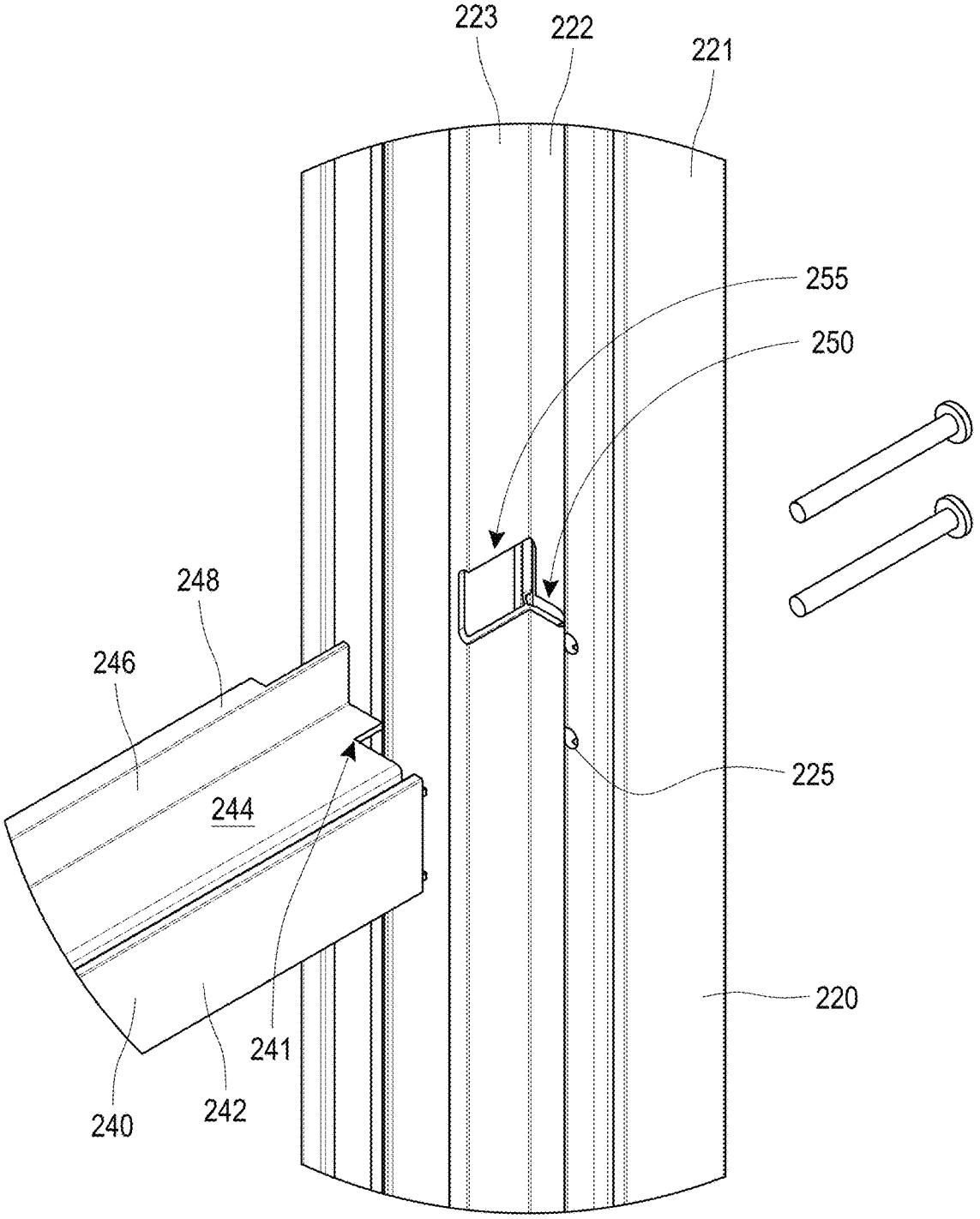
FIG. 7A is a partial exploded view of the window assembly of FIG. 2.
Figure 7B:
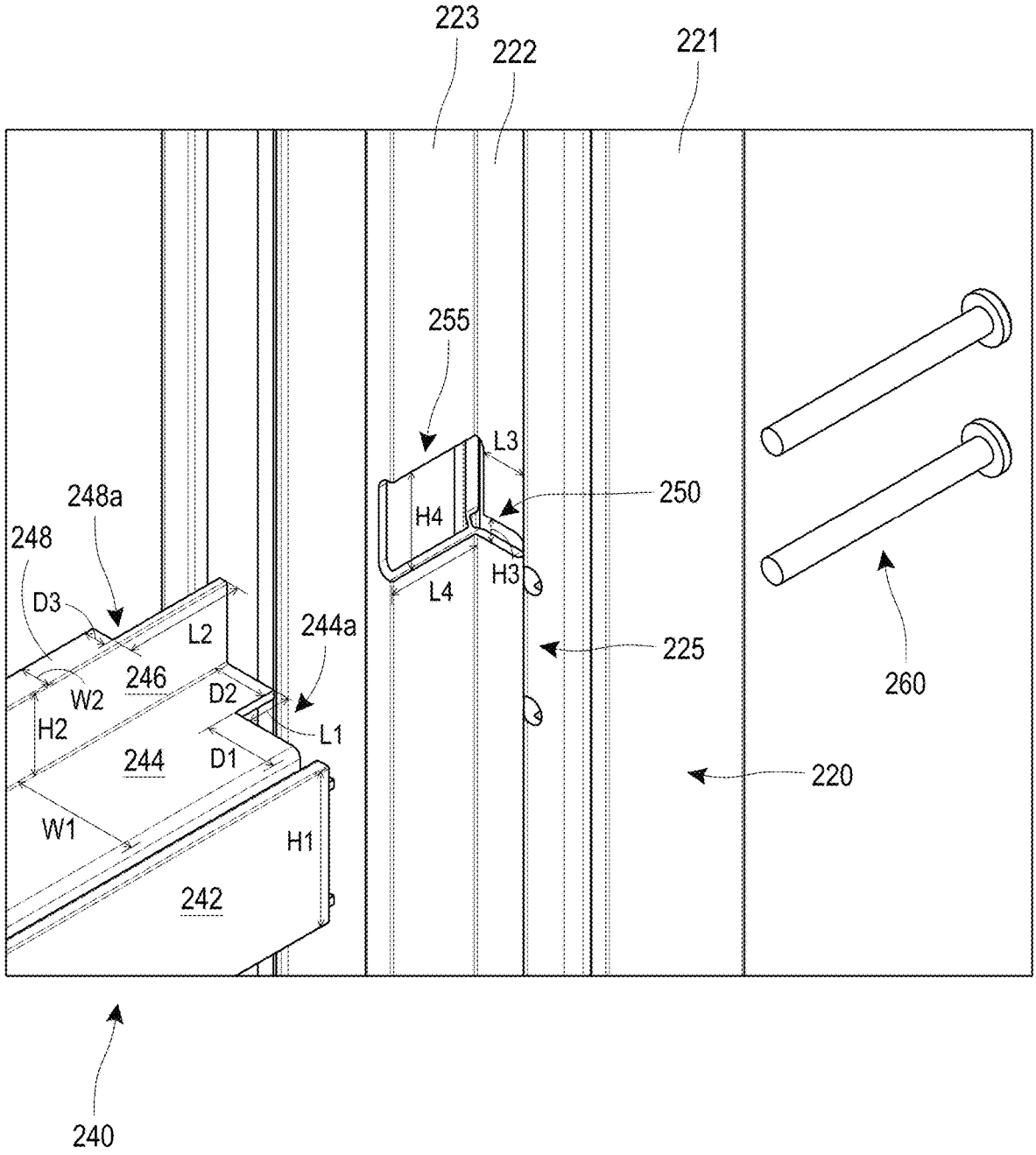
FIG. 7B is an enlarged view of FIG. 7A.
Figure 8:
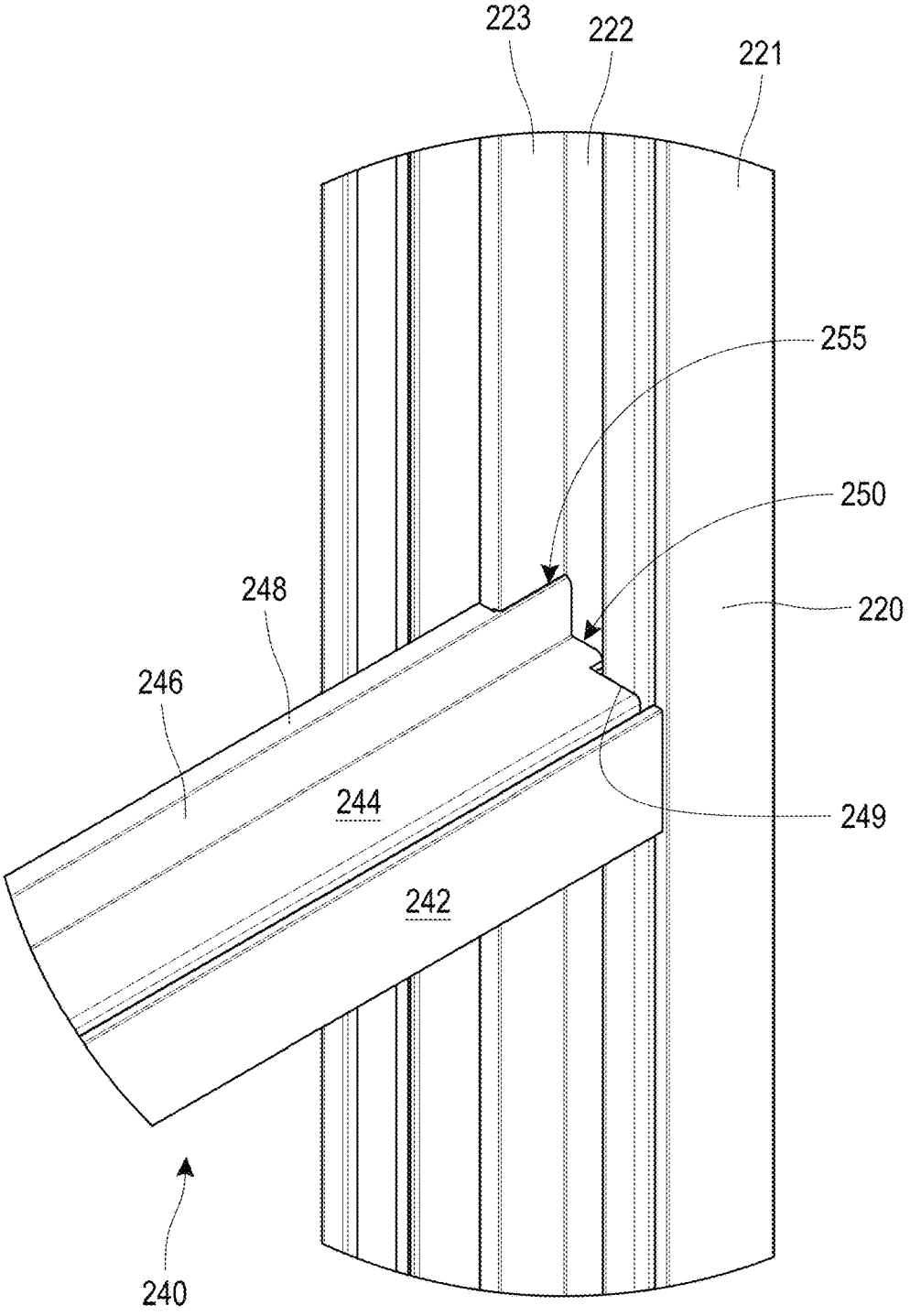
FIG. 8 is an enlarged partial view of the assembled astragal to jamb connection in the window assembly of FIG. 2.

With reference to FIGS. 7A-7B, the astragal 240 has a front upright (e.g., vertical) wall 242, a horizontal wall 244, a rear upright (e.g., vertical) wall 246 and a top (e.g., horizontal) wall 248. The horizontal wall 244 has a width W1 and a cut-out 244*a* (or opening) at a distal end 241 of the astragal 240. The cutout 244*a* can optionally be L shaped and defined by a length L1 and a depth D1. A portion of the horizontal wall 244 between the cut-out 244*a* and the rear upright (e.g., vertical) wall 246 has a depth D2 (e.g., D2+D1=W1). The top (e.g., horizontal) wall 248 has a width W2 and a cut-out 248*a* (or opening) at the distal end 241 of the astragal 240. The cutout 248*a* can optionally be L shaped and defined by a length L2 and a depth D3. The front upright wall 242 has a height H1 and the rear upright wall 246 has a height H2. In the illustrated embodiment, the height H2 is smaller than the height H1. However, in other implementations, the height H2 can be equal to or larger than the height H1.

Figure 10:
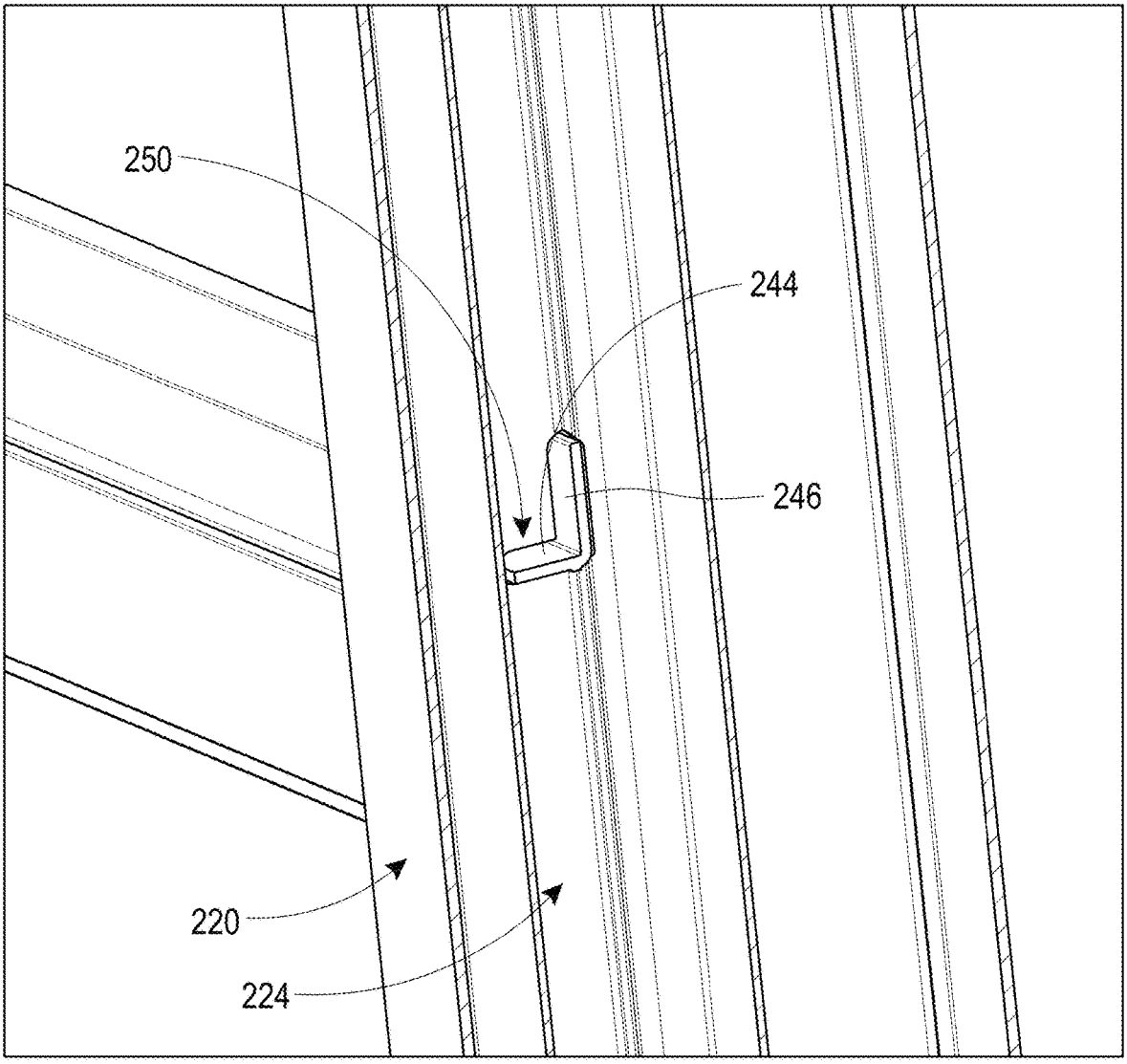
FIG. 10 is an enlarged partial cross-sectional view of the window assembly of FIG. 2 showing a cavity in the jamb of the window assembly and the astragal to jamb connection.

The jamb 220 has an outer front wall 221, an inner front wall 223 and a side wall 222 extending between the outer front wall 221 and the inner front wall 223. The side wall 222 has one or more holes 225 sized to receive one or more fasteners 260 therethrough to fasten the astragal 240 to the jamb 220. The inner wall 222 also has a channel or slot 250 formed therein that is in communication with a hollow cavity 224 (e.g., a wet cavity) inside the jamb 220, as shown in FIG. 10. The slot 250 is also in communication with a channel or slot 255 (or notch) in the inner front wall 223. The slot 250 optionally defines a generally L-shaped configuration or opening (see e.g., FIG. 6) to receive the horizontal wall 244 and rear upright wall 246 at least partially therethrough, as shown in FIG. 10. The slot 250 has a height H3 greater than (e.g., slightly larger than) a thickness of the horizontal wall 244 of the astragal 240. The slot 250 also has a length L3 greater than (e.g., slightly larger than, approximately equal to) the depth D2 of the horizontal wall 244 at the distal end 241 of the astragal 240. The slot 255 has a height H4 greater than (e.g., slightly larger than, approximately equal to) the height H2 of the rear upright (e.g., vertical) wall 246. The slot 255 has a length L4 smaller than (e.g., slightly smaller than, approximately equal to) the length L2 of the cutout 248*a*.

Figure 9:
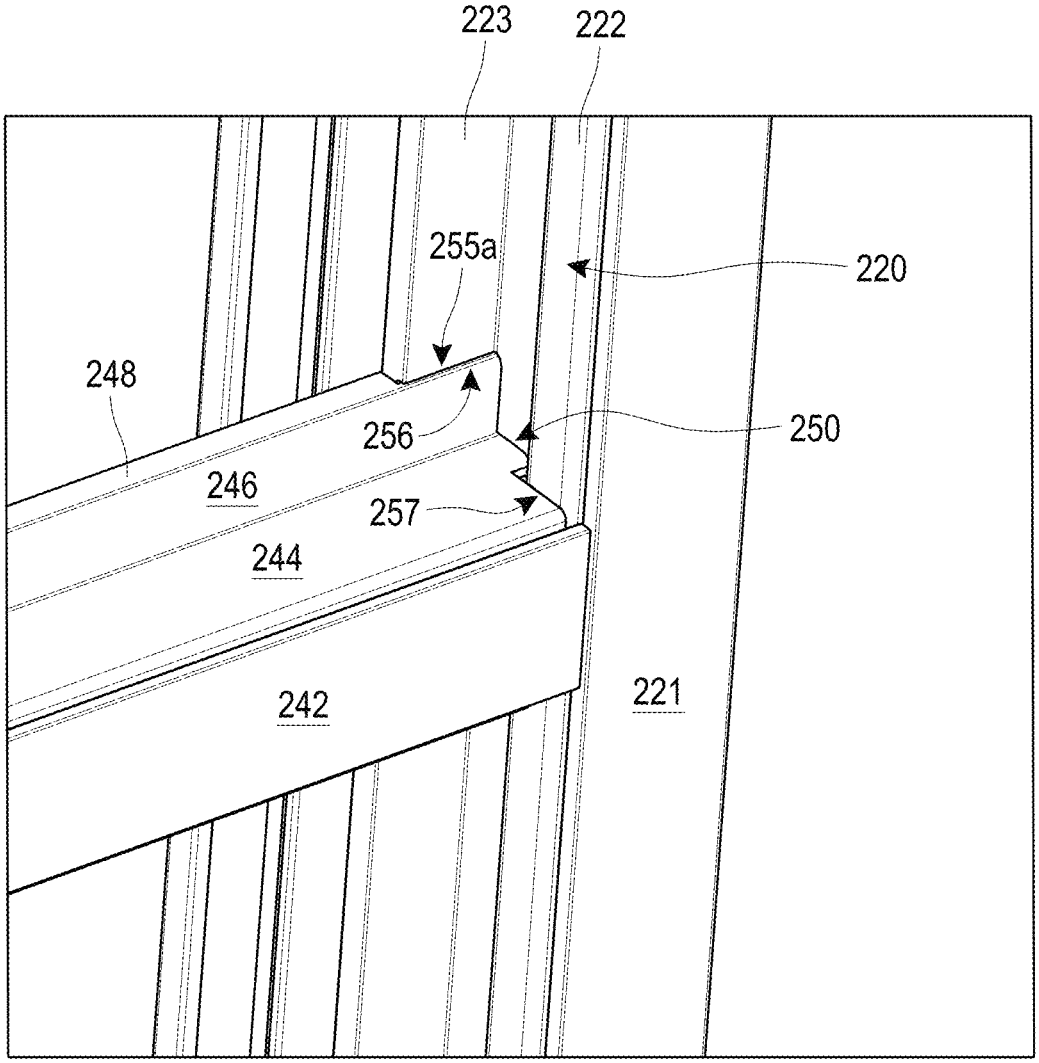
FIG. 9 is an enlarged view of the astragal to jamb connection in FIG. 8.

The slot 250 in the side wall 222 and the slot 255 in the inner front wall 223 of the jamb 220 are sized to receive at least a portion of the distal end 241 of the astragal 240 therethrough so that at least a portion of the horizontal wall 244 and rear upright (e.g., vertical) wall 246 extend (through the slot 250) into the hollow cavity 224, as shown in FIG. 10 (e.g., providing a drip edge or trough into the hollow cavity 224 that guides water into the hollow cavity 224). As shown in FIG. 9, once the astragal 240 is coupled (e.g., with the screws or bolts 260) to the jambs 220, the rear upright wall 246 extends through the slot 255 so that the top wall 248 is proximate (e.g., adjacent) the edge 255*a* of the slot 255 defining a horizontal junction 256 therebetween. Also, once the astragal 240 is coupled to the jambs 240, a portion of the horizontal wall 244 adjacent the cutout 244*a* is proximate (e.g., adjacent) the side wall 222 and defines a horizontal junction 257 therebetween.

Advantageously, the connection between the astragal 240 and the jambs 220 allows water (e.g., any water, all water) that impinges on the astragal 240 (e.g., during a storm) to be channeled (e.g., via the horizontal wall 244, rear vertical wall 246 and slots 250, 255) into the hollow cavity 224 in the jambs 220, from which the water is drained via one or more weep holes in the window assembly 200. Additionally, the horizontal junction 256 inhibits (e.g., prevents) water infiltration therethrough as water would need to flow over the height H2 of the rear upright wall 246. Further, the connection between the astragal 240 and jambs 220 advantageously does not need the application of caulk, further simplifying the manufacturing process (e.g., caulking or the use of gaskets is unnecessary in the window assembly 200). Therefore, the connection of the astragal 240 to the jambs 220 in the window assembly 200 provides a water resistant connection that excludes the use of (e.g. does not rely on) caulking.

While certain embodiments of the inventions have been described, these embodiments have been presented by way of example only, and are not intended to limit the scope of the disclosure. Indeed, the novel methods and systems described herein may be embodied in a variety of other forms. Furthermore, various omissions, substitutions and changes in the systems and methods described herein may be made without departing from the spirit of the disclosure. The accompanying claims and their equivalents are intended to cover such forms or modifications as would fall within the scope and spirit of the disclosure. Accordingly, the scope of the present inventions is defined only by reference to the appended claims.

Features, materials, characteristics, or groups described in conjunction with a particular aspect, embodiment, or example are to be understood to be applicable to any other aspect, embodiment or example described in this section or elsewhere in this specification unless incompatible therewith. All of the features disclosed in this specification (including any accompanying claims, abstract and drawings), and/or all of the steps of any method or process so disclosed, may be combined in any combination, except combinations where at least some of such features and/or steps are mutually exclusive. The protection is not restricted to the details of any foregoing embodiments. The protection extends to any novel one, or any novel combination, of the features disclosed in this specification (including any accompanying claims, abstract and drawings), or to any novel one, or any novel combination, of the steps of any method or process so disclosed.

Furthermore, certain features that are described in this disclosure in the context of separate implementations can also be implemented in combination in a single implementation. Conversely, various features that are described in the context of a single implementation can also be implemented in multiple implementations separately or in any suitable subcombination. Moreover, although features may be described above as acting in certain combinations, one or more features from a claimed combination can, in some cases, be excised from the combination, and the combination may be claimed as a subcombination or variation of a subcombination.

Moreover, while operations may be depicted in the drawings or described in the specification in a particular order, such operations need not be performed in the particular order shown or in sequential order, or that all operations be performed, to achieve desirable results. Other operations that are not depicted or described can be incorporated in the example methods and processes. For example, one or more additional operations can be performed before, after, simultaneously, or between any of the described operations. Further, the operations may be rearranged or reordered in other implementations. Those skilled in the art will appreciate that in some embodiments, the actual steps taken in the processes illustrated and/or disclosed may differ from those shown in the figures. Depending on the embodiment, certain of the steps described above may be removed, others may be added. Furthermore, the features and attributes of the specific embodiments disclosed above may be combined in different ways to form additional embodiments, all of which fall within the scope of the present disclosure. Also, the separation of various system components in the implementations described above should not be understood as requiring such separation in all implementations, and it should be understood that the described components and systems can generally be integrated together in a single product or packaged into multiple products.

For purposes of this disclosure, certain aspects, advantages, and novel features are described herein. Not necessarily all such advantages may be achieved in accordance with any particular embodiment. Thus, for example, those skilled in the art will recognize that the disclosure may be embodied or carried out in a manner that achieves one advantage or a group of advantages as taught herein without necessarily achieving other advantages as may be taught or suggested herein.

Conditional language, such as "can," "could," "might," or "may," unless specifically stated otherwise, or otherwise understood within the context as used, is generally intended to convey that certain embodiments include, while other embodiments do not include, certain features, elements, and/or steps. Thus, such conditional language is not generally intended to imply that features, elements, and/or steps are in any way required for one or more embodiments or that one or more embodiments necessarily include logic for deciding, with or without user input or prompting, whether these features, elements, and/or steps are included or are to be performed in any particular embodiment.

Conjunctive language such as the phrase "at least one of X, Y, and Z," unless specifically stated otherwise, is otherwise understood with the context as used in general to convey that an item, term, etc. may be either X, Y, or Z. Thus, such conjunctive language is not generally intended to imply that certain embodiments require the presence of at least one of X, at least one of Y, and at least one of Z.

Language of degree used herein, such as the terms "approximately," "about," "generally," and "substantially" as used herein represent a value, amount, or characteristic close to the stated value, amount, or characteristic that still performs a desired function or achieves a desired result. For example, the terms "approximately", "about", "generally," and "substantially" may refer to an amount that is within less than 10% of, within less than 5% of, within less than 1% of, within less than 0.1% of, and within less than 0.01% of the stated amount. As another example, in certain embodiments, the terms "generally parallel" and "substantially parallel" refer to a value, amount, or characteristic that departs from exactly parallel by less than or equal to 15 degrees, 10 degrees, 5 degrees, 3 degrees, 1 degree, or 0.1 degree.

The scope of the present disclosure is not intended to be limited by the specific disclosures of preferred embodiments in this section or elsewhere in this specification, and may be defined by claims as presented in this section or elsewhere in this specification or as presented in the future. The language of the claims is to be interpreted broadly based on the language employed in the claims and not limited to the examples described in the present specification or during the prosecution of the application, which examples are to be construed as non-exclusive.

Of course, the foregoing description is that of certain features, aspects and advantages of the present invention, to which various changes and modifications can be made without departing from the spirit and scope of the present invention. Moreover, the devices described herein need not feature all of the objects, advantages, features and aspects discussed above. Thus, for example, those of skill in the art will recognize that the invention can be embodied or carried out in a manner that achieves or optimizes one advantage or a group of advantages as taught herein without necessarily achieving other objects or advantages as may be taught or suggested herein. In addition, while a number of variations of the invention have been shown and described in detail, other modifications and methods of use, which are within the scope of this invention, will be readily apparent to those of skill in the art based upon this disclosure. It is contemplated that various combinations or subcombinations of these specific features and aspects of embodiments may be made and still fall within the scope of the invention. Accordingly, it should be understood that various features and aspects of the disclosed embodiments can be combined with or substituted for one another in order to form varying modes of the discussed devices.

What is claimed is:

1. A window assembly, comprising:

a polymer window frame comprising a pair of jambs, each having one or more slots formed in a vertical front facing surface and a vertical side facing surface adjacent the vertical front facing surface thereof, the one or more slots including a slot in the vertical front facing surface and a slot in the vertical side facing surface defining an L-shaped opening in the vertical side facing surface, and an astragal configured to extend between and interconnecting the pair of jambs at intermediate locations between a top end of the jambs and a bottom end of the jambs, the astragal having one or more ends with a first cutout in a horizontal wall of the one or more end portions and a second cutout in a top wall of the one or more end portions that allow at least a portion of the one or more ends of the astragal to define an L-shaped portion that extends through the slot in the vertical front facing surface and the slot in the vertical side facing surface of the jambs and into a hollow cavity of the jambs when the astragal is attached to the jambs, so as to provide a horizontal joint between the vertical front facing surface of the jambs and the astragal to inhibit water ingress to an interior side of the window, wherein the ends of the astragal are configured to channel water into the hollow cavity of the jambs via the one or more slots in the jambs for draining of said water.

2. The window assembly of claim 1, further comprising a glass unit carried by the window frame.

3. The window assembly of claim 1, wherein junctions between the astragal and the jambs excludes caulk.

4. The window assembly of claim 1, wherein the window frame is made of vinyl.

5. A window assembly, comprising:

a window frame comprising a jamb having one or more slots formed in a vertical front facing surface and a vertical side facing surface adjacent the vertical front facing surface thereof, the one or more slots including a slot in the vertical front facing surface and a slot in the vertical side facing surface defining an L-shaped opening in the vertical side facing surface, and an astragal configured to attach to the jamb, the astragal having an end portion configured to extend through the one or more slots in the jamb and into a hollow cavity of the jamb at an intermediate location between a top end of the jamb and a bottom end of the jamb, the end portion having a first cutout in a horizontal wall of the end portion and a second cutout in a top wall of the end portion that allow at least a portion of the end portion of the astragal to define an L-shaped portion that extends through the slot in the vertical front facing surface and the slot in the vertical side facing surface of the jamb and into the hollow cavity of the jamb when the astragal is attached to the jamb, so as to provide a horizontal joint between the vertical front facing surface of the jamb and the astragal to inhibit water ingress to an interior side of the window, wherein the end portion of the astragal is configured to channel water into the hollow cavity of the jamb via the one or more slots in the jamb for draining of said water.

6. The window assembly of claim 5, further comprising a glass unit carried by the window frame.

7. The window assembly of claim 5, wherein junctions between the astragal and the jamb excludes caulk.

8. The window assembly of claim 5, wherein the window frame is made of vinyl.

* * * * *